United States Patent [19]

Kleinemas

[11] 4,320,985

[45] Mar. 23, 1982

[54] APPARATUS FOR MULTIPLE SETTING OF CONCRETE PAVING BLOCKS

[75] Inventor: Harald Kleinemas, Saterland, Fed. Rep. of Germany

[73] Assignee: Optimas Bauelemente und Baugeräte GmbH, Verl, Fed. Rep. of Germany

[21] Appl. No.: 102,479

[22] Filed: Dec. 11, 1979

[30] Foreign Application Priority Data

Dec. 13, 1978 [DE] Fed. Rep. of Germany ..... 2853656

[51] Int. Cl.[3] ..... E01C 19/52

[52] U.S. Cl. ..... 404/99; 52/749; 414/623

[58] Field of Search ..... 404/99; 405/303; 414/618, 619, 620, 621, 623; 52/749, 747

[56] References Cited

U.S. PATENT DOCUMENTS

| | | | |
|---|---|---|---|
| Re. 28,305 | 1/1975 | Williamson | 52/749 |
| 1,573,263 | 2/1926 | Madden | 52/749 |
| 2,578,016 | 12/1951 | Rike | 414/623 X |
| 2,597,760 | 5/1952 | Strahm | 414/619 X |
| 4,060,955 | 12/1977 | Lachnit | 52/749 |
| 4,090,628 | 5/1978 | Sinclair | 414/623 |
| 4,168,130 | 9/1979 | Barth | 404/99 |
| 4,194,853 | 3/1980 | Barth | 404/99 X |

FOREIGN PATENT DOCUMENTS

| | | | |
|---|---|---|---|
| 105217 | 1/1927 | Austria | 52/749 |
| 971103 | 8/1950 | France | 52/749 |
| 57604 | 11/1967 | German Democratic Rep. | 404/99 |
| 238812 | 8/1925 | United Kingdom | 52/749 |

*Primary Examiner*—Nile C. Byers, Jr.
*Attorney, Agent, or Firm*—Jordan and Hamburg

[57] ABSTRACT

Apparatus for the setting of paving blocks includes a movable chassis, an outrigger arm mounted on the chassis for heightwise adjustment, and grab tong devices suspended from the outrigger arm, the grab tong devices each being operable to grip a group of paving blocks laterally. Each of the grab tong devices has opposed jaws, one of which is fixedly mounted and the other of which is movably mounted, and linkage means are provided to operably mount the movable jaw such that upon suspension of the grab tong device from the outrigger arm with paving blocks disposed between the opposed jaws, the linkage means is operable to effect a clamping action on the paving blocks to thereby provide for lifting of the paving blocks with the clamping force being proportional to the weight being lifted.

25 Claims, 6 Drawing Figures

APPARATUS FOR MULTIPLE SETTING OF CONCRETE PAVING BLOCKS

BACKGROUND OF THE INVENTION

This invention relates to an apparatus for the setting of paving blocks, containing a movable chassis, an outrigger arm that may be adjusted in its height relative to the chassis, and a grab tongs means suspended from the outrigger arm in a manner allowing it to rotate and swing, the clamping jaws of the tongs acting laterally, allowing the gripping and displacing of at least one paving block.

An apparatus of the general type described has already been developed for the placing of a larger concrete slab, with the latter having blind joints and thus giving the appearance of a blocked-paved surface. On vibrating this area, every slab would be broken around the blind joints into pieces the size of a paving block. The lines of fracture would run in an irregular pattern. Advantages of block paving over poured-concrete pavements or asphaltic pavements are, as known, the reusability of the paving blocks upon repairs, and the possibility that subterranian conduits may economically be imbedded later on. These advantages are obviated when using the larger concrete slabs previously described. Therein, the entire surface is wedged and anchored in itself, since the lines of fracture are irregular. Pieces of paving taken therefrom cannot be set again, since the irregular lines of fracture would result in joints of considerable non-uniformity.

The task has arisen of creating an apparatus which, on paving, will accelerate and simplify the setting of paving blocks, without forgoing the advantages of being able to exchange and to reuse individual paving blocks and to set them at any desired location.

According to the present invention, this task is solved by apparatus of the type as initially described, in which the grab tongs means has several grab tongs which, in the respective instance will grip, row by row, a group of paving blocks in the direction of the clamping movement of the tongs wherein, when under load, movable clamping jaws move in the direction of clamping towards opposite jaws which are fixed, these movable jaws being individually connected via a linkage with the suspension of the grab tongs means with such lever ratios that the clamping force amounts to a multiple of the load. By this, an apparatus has been created with which an entire layer of the paving blocks, which are delivered in stacks, can be grabbed, transported to the paving site, lowered, aligned by contacting the ground, and set down. This will take only a quarter of the time usually required. The paver operates this apparatus which is easy to handle, standing upright, and the stones are not touched by hand any more.

Further features and advantages of the invention are evidenced by the claims and the following description of embodiments of the invention, wherein reference is made to the following drawings.

DESCRIPTION OF THE PREFERRED EMBODIMENTS

Figure 1:
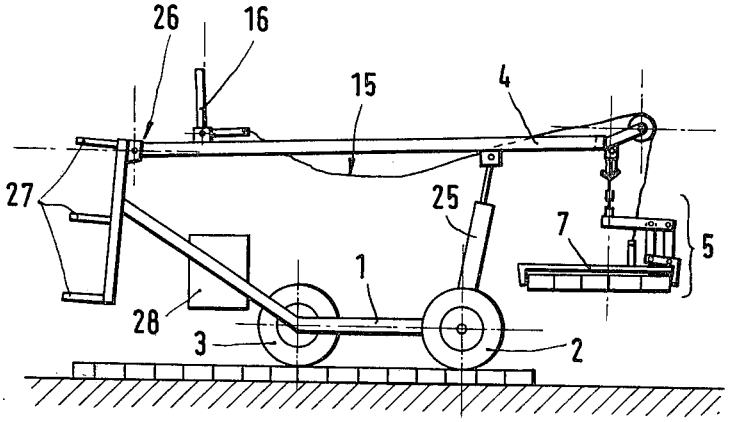
FIG. 1 is a side view of the apparatus according to one embodiment of the invention.
Figure 2:
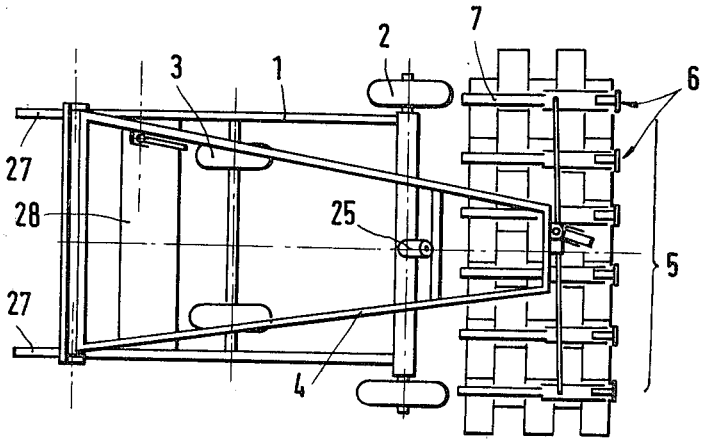
FIG. 2 is a top view of the apparatus shown in FIG. 1.
Figure 3:
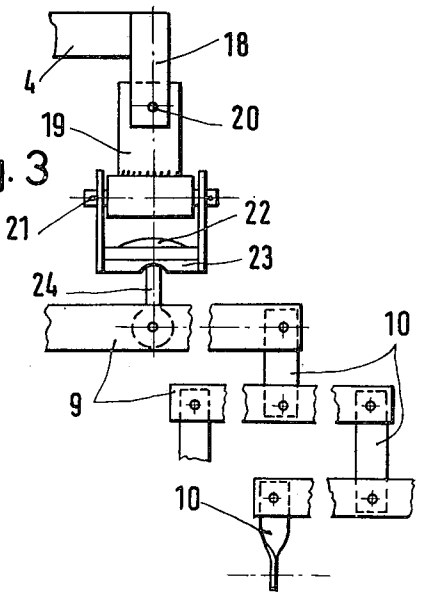
FIG. 3 is a partial front view of the grab tongs of the apparatus shown in FIGS. 1 and 2.
Figure 4:
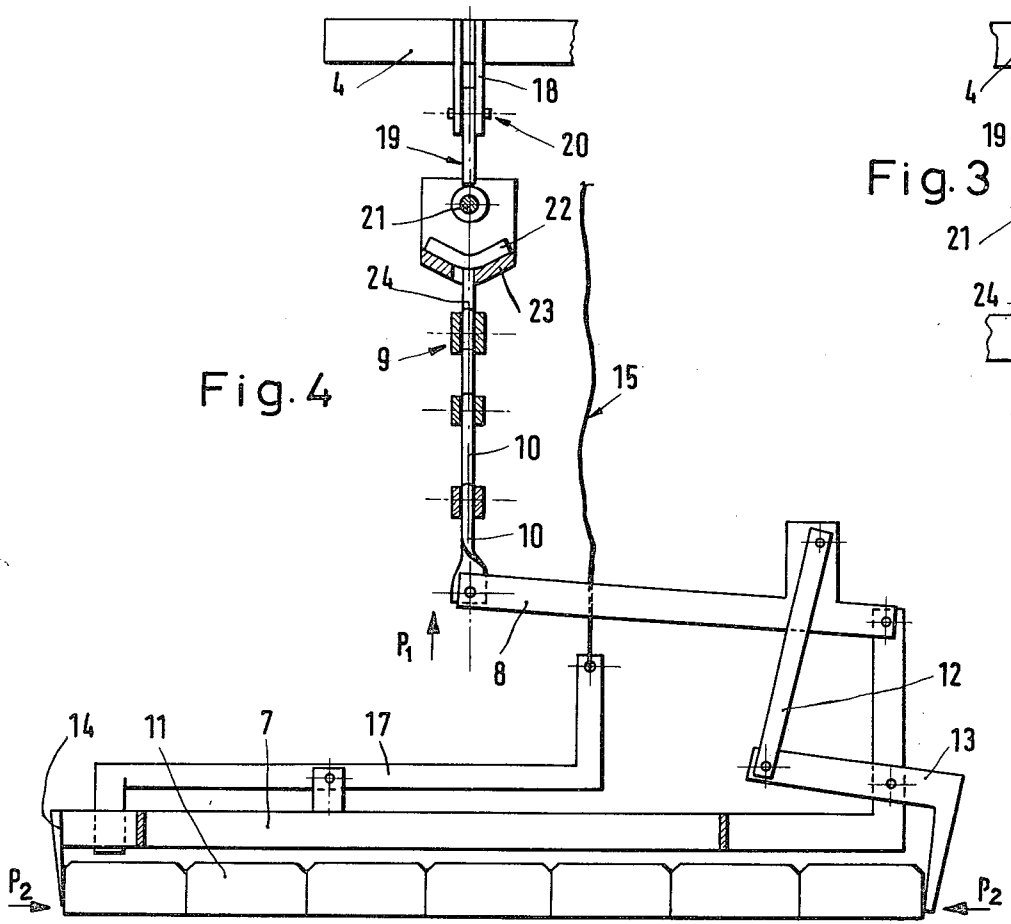
FIG. 4 is a side view of the grab tongs shown in FIG. 3.

The apparatus shown in the drawings consists of a chassis 1 having axles supporting wheels 2 and 3, a hydraulically operated outrigger arm 4, and a grab tongs means 5 suspended from the outrigger arm 4. The grab tongs means 5 consists of a plurality of grab tongs 6.

Base frames or first jaws 7 of the grab tongs 6 are rigidly connected to each other. The weight of the grab tongs means 5, including the concrete paving blocks, is so suspended on a first linkage means or carrying lever 8 that the weight under the individual grab tongs 6 is evenly distributed via members 10 by equalizer beams 9. This ensures that every individual grab tongs 6 will evenly and securely clamp the individual paving blocks even when there are varying dimensional tolerances or when there are present contaminations, such as sand, for example.

The grab tongs 6 are designed in such a manner that they do not grip below the concrete paving blocks but press, by lateral pressure, onto the rows of concrete paving blocks so that the resulting bridges, formed between the rows of concrete paving blocks 11 cannot collapse. The same effect can be obtained when the concrete paving blocks are gripped and clamped in a direction across the run of the rows.

The required clamping force $P_2$ is generated by the leverage from the force $P_1$, originating from the weight of the concrete paving blocks and parts of the grab tongs means. The carrying levers 8 are supported by the respective base frames 7 of each grab tongs. Through second linkage means or traction members 12, they transmit the resulting larger force onto the second jaws or bell crank levers 13. The bell crank levers 13 utilize the total ratio to exert a sufficient force $P_2$ which must be a multiple of the force $P_1$, sufficient to hold together the bridges formed between the individual concrete paving blocks 11. The counterforce to the force $P_2$ is absorbed by clamping jaws 14 which are rigid relative to the base frames. By this rigid attachment, the clamping jaws 14 will always be at a right angle to the concrete paving blocks 11.

When the concrete paving blocks are to be set down, it is necessary to open the grab tongs 6 of the grab tongs means 5 and to keep them opened so that the gab tongs means may be lifted off when in an empty state and the apparatus moved to the stack of concrete paving blocks. A pulling element or rope 15 can be aranged for this purpose from the base frames 7 to the operating side of the apparatus, the rope 15 being pulled and arrested by a lever mechanism 16, so that all levers of the grab tongs means 5 are relieved thereby and will, by their own weight, hold open the movable bell cranks 13 in the spread position.

The grab tongs means is then suspended from the base frames 7 and not, as on clamping, from the equalizer beam 9. Instead of a pulling rope 15, a linkage with appropriate translation of the force may also be selected for its transmission. The change in the suspension may be effected in various ways, for example by hook and eye.

On setting the paving blocks, the fixed clamping jaws 14 will be located in the joints between concrete blocks already set and those newly put down. Accordingly, it becomes necessary for the jaws to be pulled up perpendicular so that on being lifted they will not jam within the joint and cause dislocations in the concrete block pavement. For this purpose, a pushing lever 17 is supported on the base frames 7 at about midpoint between the rigid clamping jaws 14 and the center of gravity of the empty grab tongs means 5. The suspension is located at one end of the lever 17 above the center of gravity of the empty grab tongs means while the other end of the lever 17 can rest against the paving blocks close to the clamping jaws 14. By this arrangement the force on taking up the empty grab tongs means will initially be so transferred that the lever 17 will rest against the concrete paving blocks 11, and the clamping jaws 14 will be lifted out of the joints. Movement of the lever 17 is limited by stops in such a manner that only the travel necessary for lifting-out of the jaws 14 is allowed.

It must be made possible to have the layer of concrete blocks exactly abut the existing pavement. For this purpose, the grab tongs means 5 must allow for rotating and swinging in all directions. Furthermore, the suspended layer of concrete blocks must always be hanging horizontally, independent of the respective position of the apparatus. Thus, the suspension of the outrigger arm 4 with the rigidly attached arm 18, is linked pivotable via a pin 20 to the bored member 19. A trunnion or pin 21 allows pivoting in a direction offset by 90°. To allow rotation around a vertical center axis, a convex horizontal disc 22 rests in a matching socket 23. The disc 22 is rigidly connected to a pin 24 which has an eye at its other end.

Rotation is possible between socket 23 and disc 22, wherein the disc 22 will slide up on the incline of the socket 23. A resistance must be overcome, but upon a reduction in the rotative force, the disc 22 will return to the initial position. Thus, the grab tongs means will always right itself relative to the remainder of the apparatus.

In order to raise the grab tongs element 5 to such a height that a layer of concrete paving blocks can be lifted from a stack up to 1.20 meters high, the outrigger arm 4 is elevated by a hydraulic cylinder 25. The outrigger arm 4 will pivot around a bearing 26.

A pressure vessel mounted on the apparatus us partially filled with oil, but mainly with compressed air. In the present embodiment, the chassis 1 is formed by tubing and serves concomitantly as a pressure vessel. From the lower zone which is filled with oil under pressure, a pipe leads via a non-illustrated hand-operated valve to the hydraulic cylinder 25.

In order to extend the hydraulic cylinder 25, the hand valve is opened, and the empty grab tongs means 5 can be brought up to a greater height. The oil which is under pressure, will extend the hydraulic cylinder. The grab tongs means 5 which has been brought to the height corresponding to the concrete block stack, is arrested heightwise by closing the hand valve, since only oil is contained within the hydraulic cylinder 25 and the piping.

An upper layer of concrete paving blocks is taken from the stack by the grab tongs means 5 and the apparatus is moved away from the stack. The pressure in the hydraulic cylinder 25 is correspondingly raised by the weight of the layer of concrete paving blocks suspended in the grab tongs element 5. If the hand valve is now opened, the oil, under higher pressure will flow from the hydraulic cylinder back into the pressure vessel. That means that the load is lowered. Speed and stopping of lowering is regulated by means of the hand valve.

Alternatively, the outrigger arm may also be lifted without a compressed oil reservoir by the spring force of a pretensioned spring, wherein the hydraulic cylinder 25 is extended simultaneously. In this case, the hydraulic cylinder will serve only for lowering and arresting. The oil reservoir is then not under pressure. Lowering is made as already described before, wherein the springs are again tensioned stronger thereby.

As per a further alternative embodiment the outrigger arm 4 is lifted by a spring force, and a mechanical brake is used instead of the hydraulic cylinder described before.

Lifting of the layer of concrete paving blocks is made by tilting the entire apparatus about the axle on which wheels 2 are mounted, as with a hand trolley. Setting down of the concrete paving blocks is made in the same manner.

In order to reach over a wider zone when tilting the apparatus, without having the hands at an uncomfortable height, several handles 27 are appropriately arranged above each other.

Depending upon the weight of the concrete paving blocks, several concrete paving blocks may be laid into the basket 28 to serve as a counterweight. This will reduce pressure exerted onto the hands and facilitate operation. A container for sand or the like may also be installed instead of the basket 28.

It will be appropriate for overcoming differences in height at the site, when the wheels of the wheel axle 2 are braked individually and separately. The brake, or arrested wheel respectively, will then serve as a fixed fulcrum allowing the other wheel to roll over an obstacle by laterally turning the entire apparatus. Operating levers for the brakes are located at the handles 27, so that the latter need not be released. Transmission to the brakes on the wheels may be made by means of linkage, rope pull or Bowden cable.

Not all concrete paving blocks are delivered to the paving site as they should be lying in the finished pavement. Rectangular blocks, for example, are often lying in a layer of the stack in such a way that the joints cross each other.

In order yet to allow setting with the apparatus of the present invention, an accessory device is utilized for rearranging of the concrete paving blocks within the layer of concrete paving blocks. To avoid dependency upon sources of energy such as electricity or motors the weight of the concrete paving blocks is used as the initial force.

Figure 5:
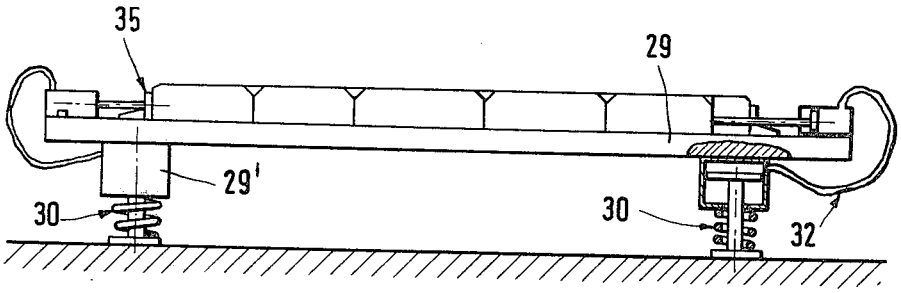
FIG. 5 is a side view of an accessory device.
Figure 6:
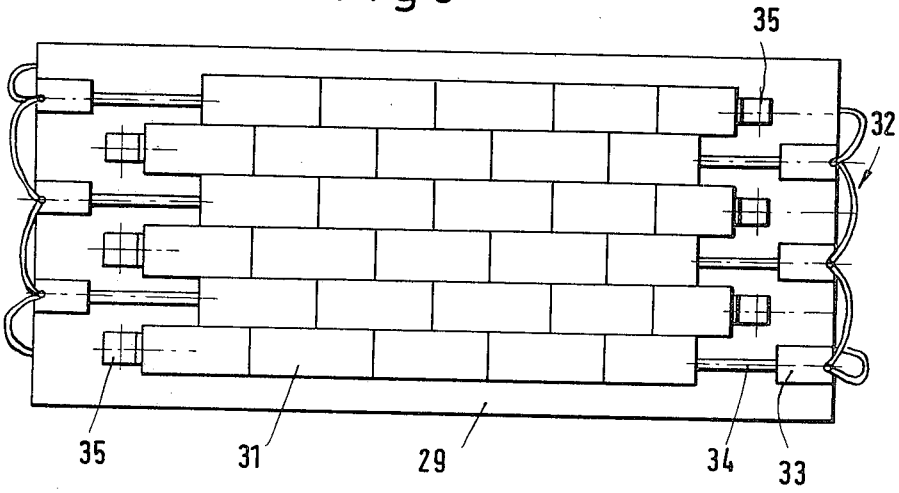
FIG. 6 is a top view of the accessory device shown in FIG. 5.

An accessory device provided herefor and shown in FIGS. 5 and 6 consists of an arranging table 29 with four legs 29'. The legs 29' are designed as hydraulic cylinders which, when the arranging table 29 is not loaded, are held in their extended position by springs 30. By loading a concrete paving block layer 31, the springs are compressed and the hydraulic cylinders compressed. The oil displaced thereby is pressed through interconnected piping 32 into horizontal acting operating cylinders 33 on the arranging table 29. The piston rods 34 of the operating cylinders 33 will now extend, pushing the rows of conrete blocks against the oppositely arranged stops 35.

After the apparatus has taken up the layer of concrete paving blocks 31, the springs 30 will effect lifting of the arranging table 29 as well as extending of the hydraulic cylinders of the legs 29' and retracting of the piston rods 34.

Translating the lowering movement of the arranging table 29 into the horizontal movement of the rows of concrete paving blocks may also be effected by a linkage mechanism in connection with retacting springs or a counterweight.

The arranging table 29 may also be provided with rigid legs, mounted at one side. A counterweight provides for the horizontal position in the unloaded state. With a layer of concrete paving blocks loaded upon the arranging table 29, it will tilt and assume such an inclined position that the layer of concrete paving blocks will slide upon it, until every row of concrete paving blocks slides against a stop. In order to reduce the friction of the concrete paving blocks, the arranging table 29 may be constructed as a roller table.

After the rearranged layer of concrete paving blocks has been taken up by the apparatus, the arranging table 29 is tilted back to its initial horizontal position.

What is claimed is:

1. Apparatus for lifting a plurality of rows of paving blocks comprising a movable chassis, an outrigger arm mounted on said chassis for heightwise adjustment, grab tong means suspended from said outrigger arm, said grab tong means comprising a plurality of grab tong devices each operable to simultaneously grip a row of paving blocks laterally, each of said grab tong devices having a pair of first and second opposed jaws, said first jaw of each pair being rigidly connected to each other, first linkage means pivotally connected between said first jaws and said outrigger arm for suspending each of said first jaws from said outrigger arm, and second linkage means pivotally connecting each of said second jaws to said first jaw of each pair such that upon suspension of the grab tong means from said outrigger arm with a row of paving blocks disposed between each pair of first and second jaws said first and second linkage means is operable to effect a clamping action on each row of paving blocks disposed therebetween, each of said second jaws of each pair being separately pivotally connected to the first jaw of the respective pair such that the distance between each pair of jaws for each row of paving blocks clamped therebetween is variable to accommodate variations in the lengths of paving block rows due to contaminates and manufacturing tolerances, whereby each pair of first and second jaws adapts itself to the individual rows of paving blocks to thereby provide lifting of each row of paving blocks according to the length of each of the rows of paving blocks and proportional to the weight of each of the rows of paving blocks being lifted.

2. Apparatus according to claim 1, wherein said first linkage means comprises a plurality of equalizer beams by which each of said grab tong devices are suspended to provide even distribution of the weight along said equalizer beams.

3. Apparatus according to claim 2 wherein each of said first jaws comprises a first jaw element disposed generally horizontally when lifting paving blocks and a second jaw element extending generally perpendicularly from said first jaw element, each of said first jaws further comprising a gripping element extending generally perpendicularly from said first jaw element for engaging said paving blocks, said first linkage means comprising a first linkage arm pivotally connected to one of said equalizer beams and pivotally connected to said second jaw element.

4. Apparatus according to claim 3 wherein said first jaw element is generally parallel to said first linkage arm when lifting paving blocks.

5. Apparatus according to claim 3 wherein each of said second jaws comprises a bell crank element having two joined legs, one of said legs being engageable with the paving blocks being gripped, the other of said legs being pivotally connected to said first jaw element, said second linkage means comprising a second linkage arm pivotally connected to said second leg of said bell crank element and pivotally connected to said first linkage arm.

6. Apparatus according to claim 5 wherein said other leg of said bell crank element is pivotally connected to said first jaw element at a position along said other leg which is between the pivotal connection between said other leg and said second linkage arm and the connection of said two legs of said bell crank element.

7. Apparatus according to claim 5 wherein said first linkage arm has an upright projection projecting perpendicularly from said first linkage arm, said second linkage arm being pivotally connected to said upright projection.

8. Apparatus according to claim 3 wherein said first jaw element extends substantially the length of the row of paving blocks being lifted, one end of said first jaw element having said gripping element extending substantially perpendicularly therefrom, the other end of said first jaw element having said second jaw element extending perpendicularly from said first jaw element, said first linkage arm being pivotally connected to said equalizer beam at substantially the center of the row of paving blocks being lifted, said second linkage arm and said second jaw being located substantially to one side of said center.

9. Apparatus according to claim 1 further comprising releasing means on said grab tong devices for releasing the clamping jaws, said releasing means being operable to suspend said grab tong device when the latter is empty of paving blocks.

10. Apparatus according to claim 9, further comprising a base frame to which each of said fixed jaws is fixed, said releasing means comprising a lever pivotally mounted on said base frame, and a suspension means connected to said lever for suspending said grab tong device when the latter is empty of paving blocks.

11. Apparatus according to claim 10, wherein said lever has one end adopted to engage the paving blocks when said lever is pivoted by said suspension means.

12. Apparatus according to claim 1, wherein each of said second linkage means comprises a pivotally mounted bell crank lever operable by a plurality of pivotally connected levers to provide for pivoting of the bell crank lever to effect said clamping action.

13. Apparatus according to claim 1 further comprising self-returning mounting means for mounting said grab tong means from said outrigger arm so as to allow the grab tong means to rotate and swing, and providing for self-returning of the self-returning mounting means to a resting position in which the grab tong means is suspended in a natural state of gravity.

14. Apparatus according to claim 13, wherein said self-returning mounting means comprises a slidable bearing element slidable on inclined bearing support surfaces to provide said self-returning of the self-returning mounting means to said resting position.

15. Apparatus according to claim 13, wherein said self-returning mounting means comprises a double-acting retraction spring.

16. Apparatus according to claim 1 further comprising a hydraulic system means for effecting heightwise adjustment of the outrigger arm, said hydraulic system means comprising a hydraulic supply vessel which is partially filled with a liquid and which is partially under gas pressure, and a manually operable hydraulic control valve for actuating and controlling operation of said hydraulic system means.

17. Apparatus according to claim 16, wherein said chassis is made from tubing, at least portions of said tubing being pressurized by said hydraulic system means.

18. Apparatus according to claim 1 comprising a support structure mounted on said chassis, said support structure comprising a plurality of handles disposed at a convenient operating height on tilting of the apparatus.

19. Apparatus according to claim 1 comprising a container means on said support structure for receiving a counter-weight to effect counter balancing when the apparatus is lifting paving blocks.

20. Apparatus according to claim 1, wherein said chassis has axles on which wheels are rotatably mounted, and two independent brakes on the wheels of one axle which are independently manually operable.

21. Apparatus according to claim 20, wherein two axles are provided which are parallel to one another, and at least three wheels are rotatably mounted on said axels.

22. Apparatus according to claim 1 further comprising an accessory device providing for row-by-row alignment of a layer of paving blocks, said accessory device comprising a table, means for raising and lowering said table, and pusher means operable by the raising and lowering of said table, whereby the pusher means are extended to effect said alignment of the paving blocks upon lowering of said table due to the weight of the paving blocks placed on the table.

23. Apparatus according to claim 1 further comprising an accessory device providing row-by-row alignment of a layer of moving blocks, said accessory device comprising a table which is tiltable when a layer of paving blocks is placed thereon, and stop means mounted on said table, whereby the rows of paving blocks will slide against said stop means during said tilting of the table to thereby effect said alignment.

24. Apparatus according to claim 22 or 23, wherein said table has a plurality of rollers on its surface on which said paving blocks are adopted to roll.

25. Apparatus for lifting a plurality of rows of paving blocks comprising grab tong means suspended from a support, said grab tong means comprising a plurality of grab tong devices each operable to simultaneously grip a row of paving blocks laterally, each of said grab tong devices having a pair of first and second opposed jaws, said first jaw of each pair being rigidly connected to each other, first linkage means pivotally connected between said first jaws and said support for suspending each of said first jaws from said support, and second linkage means pivotally connecting each of said second jaws to said first jaw of each pair such that upon suspension of the grab tong means from said support with a row of paving blocks disposed between each pair of first and second jaws said first and second linkage means is operable to effect a clamping action on each row of paving blocks disposed therebetween, each of said second jaws of each pair being separately pivotally connected to the first jaw of the respective pair such that the distance between each pair of jaws for each row of paving blocks clamped therebetween is variable to accommodate variations in the lengths of paving block rows due to contaminates and manufacturing tolerances, whereby each pair of first and second jaws adapts itself to the individual rows of paving blocks to thereby provide lifting of each row of paving blocks according to the length of each of the rows of paving blocks and proportional to the weight of each of the rows of paving blocks being lifted.

* * * * *